United States Patent [19]

Cvetanovich

[11] Patent Number: 5,070,635

[45] Date of Patent: Dec. 10, 1991

[54] FIRING CHAMBER SAFETY PLUG

[76] Inventor: David A. Cvetanovich, 40 Cedar Rd., Eliot, Me. 03903

[21] Appl. No.: 718,194

[22] Filed: Jun. 20, 1991

[51] Int. Cl.[5] ..... F41A 17/44
[52] U.S. Cl. ..... 42/70.11; 42/96
[58] Field of Search ..... 42/70.01, 70.11, 96

[56] References Cited

U.S. PATENT DOCUMENTS

| | | | |
|---|---|---|---|
| H,213 | 2/1987 | Panlaqui | 42/96 |
| 3,360,880 | 1/1968 | Finnegan | 42/70.11 |
| 3,382,596 | 5/1968 | Rockwood | 42/70.11 |
| 3,444,639 | 5/1969 | Rockwood | 42/70.11 |
| 3,678,609 | 7/1972 | Fazio . | |
| 3,848,350 | 11/1974 | Seminiano | 42/1 N |
| 4,776,123 | 10/1988 | Ascroft | 42/70.11 |
| 4,835,894 | 6/1989 | Libassi | 42/70.11 |
| 4,965,952 | 10/1990 | Miller et al. | 42/70.01 |
| 5,014,457 | 5/1991 | Lewis et al. | 42/70.11 |

FOREIGN PATENT DOCUMENTS

| | | | |
|---|---|---|---|
| 2143623 | 2/1985 | United Kingdom | 42/70.11 |
| 2158924 | 11/1985 | United Kingdom | 42/70.11 |
| 2200438 | 8/1988 | United Kingdom | 42/70.11 |

OTHER PUBLICATIONS

Kamiya, Barrel Plugs and Muzzle Brakes, Action Pursuit Game, Dec. 1990, p. 106.

Photograph of Related Art Sold by L. L. Bean Co., Freeport, Me.

*Primary Examiner*—Deborah L. Kyle
*Assistant Examiner*—Richard W. Wendtland
*Attorney, Agent, or Firm*—William B. Ritchie

[57] ABSTRACT

A safety plug for preventing firearms from being surreptitiously loaded while on display in stores. The plug utilizes an O-ring that serves to firmly hold the safety plug in place. The use of an O-ring eliminates the need for high precision plug dimensions, permitting inexpensive mass production manufacturing techniques. The O-ring fits within a groove that is substantially wider than the thickness of the O-ring which prevents O-ring shearing. Once inserted, the safety plug is entirely within the firing chamber and thus does not interfere with the operating action of the firearm. The plug can only be removed by a cleaning rod inserted through the muzzle to force the plug out of the firing chamber. The use of translucent materials enables the firearm barrel to be inspected and acts as a diffuser to eliminate "hot spots" that commonly result during bore light inspections. An alternative embodiment for semi-automatic firearms provides a visual "safety" as the action remains partially open once the plug is inserted.

6 Claims, 2 Drawing Sheets

FIRING CHAMBER SAFETY PLUG

BACKGROUND OF THE INVENTION

1. Field of the Invention

The invention relates to firearm safety devices.

2. Description of the Related Art

The need for providing a reliable, low cost safety device for firearms has long been recognized. A vast number of solutions have been proposed. Trigger locks, locking cabinets, safety plugs are a few of the many types of proposed devices.

While many of the devices proposed ensure that the firearm cannot be fired, these devices are impractical for businesses which engage in selling firearms. In order to sell the firearms, reasonable access must be available to the general public to test the actions, inspect the barrels, etc. However, it is inherently easy for a deranged person to surreptitiously load the firearm during this inspection process with the expectation that the next test by someone else will result in an accidental discharge.

Therefore, firearms must be readily available for inspection and testing yet inherently safe from having a live round being loaded. Trigger locks and other similar devices do not enable the firearm to be tested. Removal of the lock for testing destroys the effectiveness of the safety. Rods which lock into the barrel again interfere with the customer's ability to inspect the firearm. Further, such devices are too expensive to be used for each firearm within the store.

Another safety problem results from the use of semi-automatic weapons for police work. Most police forces today have switched to the use of semi-automatic handguns, in particular, 9 mm caliber. When the police officer returns home at the end of his/her shift, it is customary to unload the weapon and remove the clip. While it is easy to visually inspect whether the clip is removed, the presence or absence of a round in the chamber cannot be determined without activating the slide to open the action. It would be advantageous to be able to visually confirm that the weapon was unloaded. It would also be advantageous to provide a visual reminder to prompt the officer to reload the weapon before returning to duty.

U.S. Pat. No. 4,776,123, issued to Ascroft on Oct. 11, 1988, discloses a safety plug for firearm chambers that is incapable of being ejected by the firearm's cartridge extractor mechanism. The device is press fitted in the bore of the firearm by having a diameter greater than the bore of the weapon. To fit properly requires the diameter of the plug to be precisely determined relative to the barrel bore. Variations in wear of the bore or deposits within would require corresponding adjustments in the plug diameter. As a pressure fit has small surface area of contact between the plug and the firearm, jarring the firearm could cause the safety plug to drop out.

U.S. Pat. No. 3,444,639, issued to Rockwood on May 20, 1969, discloses another safety plug for firearm chambers. This design is capable of being ejected by the firearm extractor mechanism. Therefore, anyone can disable the safety device simply by ejecting the plug.

U.S. Pat. No. 3,848,350, issued to Seminiano on Nov. 19, 1974, discloses still another plug. The primary objective of this device is to serve as a "dry fire" plug for center-fire or shotguns. Again, this plug can be ejected using the firearm extractor mechanism.

U.S. Pat. No. 3,678,609, issued to Fazio on July 25, 1972, discloses still another safety plug. This device is friction fitted within the firing chamber by having the outer diameter of the plug being slightly greater than the diameter of the firing chamber.

Another "dry fire" plug design for shotguns being sold by the L. L. Bean Co., of Freeport, Me., features an O-ring set within a groove that locates the device within the firing chamber of the shotgun. The O-ring is snugly fit within the groove and is designed for a loose fit so that the plug can be ejected using the firearm extractor mechanism.

None of these devices is suitable to economically solve the safety problems described above.

SUMMARY OF THE INVENTION

It is an object of the invention to provide a safety plug that can be easily fabricated without requiring high tolerances.

It is an object of the invention to provide a safety plug that can be adapted to fit a range of caliber sizes.

It is another object of the invention to provide a safety plug that can render semi-automatic weapons safe with the action partially open so that the user can visually determine the status of the weapon.

It is still another object of the invention to provide a safety plug that will enable the barrel of the firearm to be inspected while the safety plug is in place.

It is still a further object of the invention to provide a safety plug that cannot be removed by fingers, pliers, or other such means but can only be removed by the insertion of a rod through the muzzle of the firearm to push the safety plug free from the firing chamber.

A final object of the invention is to provide a safety plug for firearms that is so inexpensive that stores selling firearms can use one for each weapon so that all firearms on display cannot be loaded without first removing the plug by the insertion of a cleaning rod through the muzzle to force the plug out of the firing chamber.

The invention is a safety plug for insertion into a firing chamber of a firearm. The firearm has a caliber designation, a barrel, muzzle, action and a chamber with a diameter and length. The safety plug comprises a cylindrical body portion having a diameter slightly less than the diameter of the firing chamber of said firearm. The safety plug has a length slightly less than the length of the firing chamber of said firearm. An O-ring is provided having a diameter and a thickness corresponding to the caliber of said firearm. An O-ring groove is provided that is disposed circumferentially on said body portion. The groove depth is less than the thickness of said O-ring. The groove width is substantially greater than the thickness of said O-ring. When the O-ring is inserted within said O-ring groove and said plug is inserted in the firing chamber of said firearm, said plug is firmly held entirely within said firing chamber. This permits the action of said firearm to fully close. Further, this renders said firearm safe until said plug is removed by insertion of a rod into the muzzle of said firearm to push said plug free from said firing chamber.

DETAILED DESCRIPTION OF THE INVENTION

Figure 1:
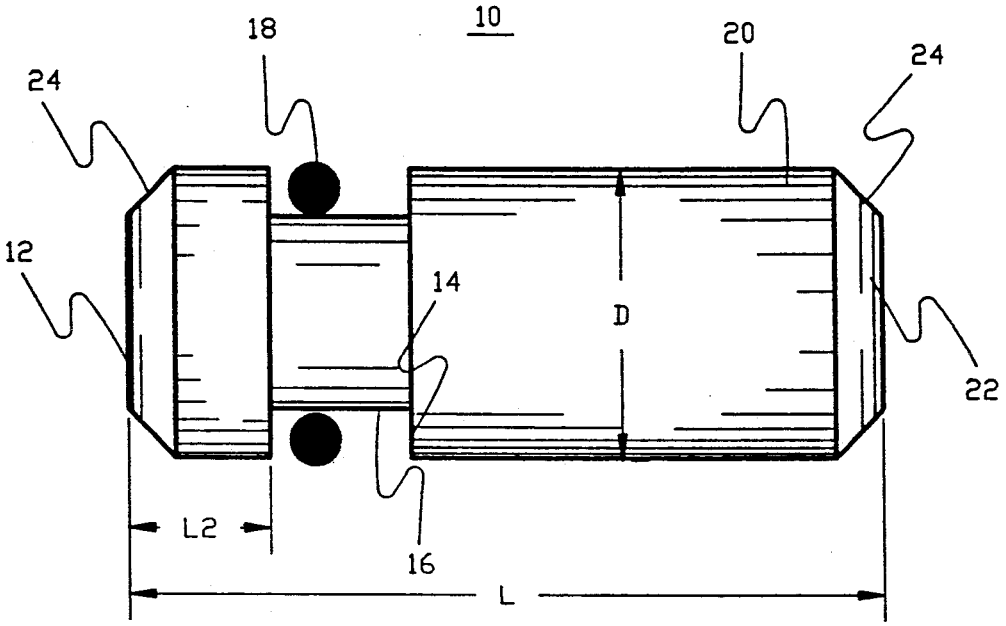
FIG. 1 is a side view of the preferred embodiment of the safety plug in accordance with the invention.

FIG. 1 is a side view of the preferred embodiment of the safety plug 10. End 12 is the muzzle end of the safety plug which is to be inserted within the firing chamber of the firearm. Body length L is designed to be less than the length of the firearm's firing chamber so the action end 22 of safety plug 10 will be set flush with the end of the firing chamber when inserted in the firearm.

Diameter D of body 20 is slightly less than the diameter of the firing chamber. In many rifle calibers, the firing chamber is tapered to fit the taper of the cartridge. Chamfer 24 is provided on ends 12 and 22 to facilitate insertion of safety plug 10 within the firing chamber of the firearm.

The inventor has found that by averaging the diameter of body 20 in accordance with the diameter of firing chambers in the region adjacent to the forcing cone for a family of calibers, and by proper selection of O-ring groove width and depth, and by proper selection of an O-ring size, one sized safety plug is able to accommodate the entire family of calibers sizes.

For example, a thirty caliber safety plug 10 will fit 30-40 Craig; 30-06; 308; 25-06; 7 mm; and 270 calibers. Of course, some sizes of safety plug 10 will fit only a single caliber, for example, 22 caliber size.

The preferred dimensions for the thirty caliber safety plug are: body 20 having a diameter of approximately 0.437 inches, a length of approximately 1 inch long; an O-ring size 011 (AS-568 sizes, i.e., 0.301 inches I.D., 0.070 inches width); Groove depth 14 of approximately 0.04 inches; and groove width 16 of approximately 0.125 inches.

A 223 caliber safety plug, which will also fit a 222 caliber, requires body 20 having a diameter of approximately 0.370 inches; a length approximately ¾ inches long; an O-ring size 010; groove depth 14 of approximately 0.06 inches; and groove width 16 of approximately 0.125 inches. Other firearm calibers are similarly proportionately sized.

The distance of the beginning of the groove from end 12, $L_2$ is not critical but preferably is between 3/16 to ¼ inches. If $L_2$ is less than this amount, body 20 may lack sufficient strength in that region to withstand a forcible attempt to chamber a round in the firearm. Dimensions greater than this preferred range will prevent the safety plug 10 from securely seating within the firing chamber when end 12 is adjacent to the forcing cone of the firearm.

If a cartridge is attempted to be loaded into the firing chamber, it will cause safety plug 10 to be pressed forward with end 12 tight against the start of the forcing cone area, just forward of the firing chamber and firmly held by compression of O-ring 18 against the walls of the firing chamber.

The inventor has found that the extra width of groove width 16 beyond the width necessary to seat the width of the O-ring is critical to the proper function of the invention. Without this extra width, the O-ring 18 will shear when safety plug 10 is inserted in the firearm. This is especially true with older model firearms which have little chamfer leading into the firing chamber opening. This extra width of the O-ring groove allows O-ring 18 the freedom to move within the groove without shearing while O-ring 18 is being compressed within the muzzle end of the firearm firing chamber.

When safety plug 10 is inserted at least flush with the action end of the firing chamber, the action of the firearm can be closed as safety plug 10 will not interfere with the mechanism of the weapon. The inventor has found that safety plug 10 cannot be dislodged by jarring the firearm. Rather, a cleaning rod or other rod must be inserted from the muzzle end of the barrel to force safety plug 10 from the firing chamber.

Body 20 is preferably fabricated from plastic or other material that will not cause damage to the firing chamber of the firearm. When safety plug 10 is used for firearm stores to prevent unauthorized loading of the store's display firearms, it is preferable that body 20 be fabricated from a translucent plastic. In that manner, the barrel of the firearm can be inspected. In fact, the inventor has found that the use of safety plug 10 fabricated from translucent plastic improves the ability to examine the firearm. The body 20 of the safety plug 10 acts as a light diffuser when a bore light is inserted into the breech of the firearm. This eliminates barrel "hot spots" when viewing the barrel from the muzzle.

While initial models have been fabricated by machining bar stock to the proper dimensions and then cutting to length, other fabrication methods such as injection molding would also be acceptable and may prove to have a cost advantage.

Figure 2:
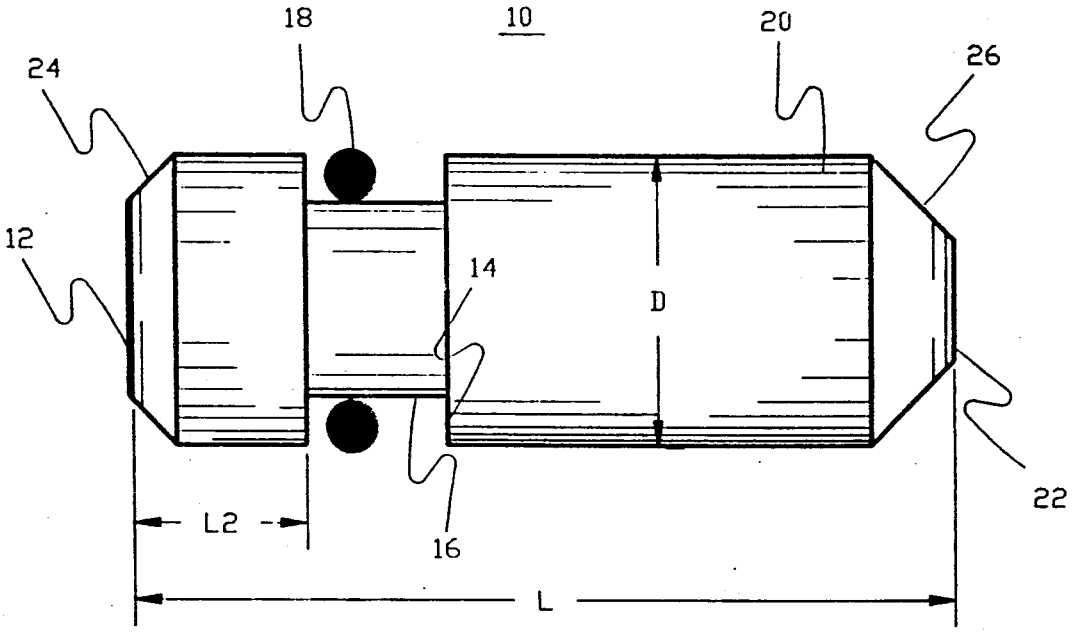
FIG. 2 is a side view of an alternative embodiment of the safety plug for use in semi-automatic firearms to provide a visual determination of the status in accordance with the invention.

FIG. 2 is a side view of an alternative embodiment of the safety plug for use in semi-automatic firearms to provide a visual determination of the status in accordance with the invention. In this embodiment, L is dimensioned so that once end 12 is firmly in contact with the forcing cone of the firearm, end 22 partially extends into the action of the firearm thus holding the slide of the weapon partially open. Chamfer 26 which is substantially greater than chamfer 24 is provided to prevent safety plug 10 interfering with the extractor mechanism of the firearm.

By holding the action of the firearm, partially open, the firearm can easily be determined as safe by visual inspection. Further, by color-coding the body 20 at least in the vicinity of end 22 with a color signifying that the firearm is safe such as brilliant green, a police officer would be reminded to re-load his service weapon before going on duty again.

Again, as in the preferred embodiment, while safety plug 10 remains in the firearm, a cartridge cannot be loaded into the firearm. Safety plug 10 must be removed by inserting a cleaning rod or other rod through the muzzle of the firearm to forcibly push the safety plug 10 from the firing chamber of the firearm.

Figure 3:
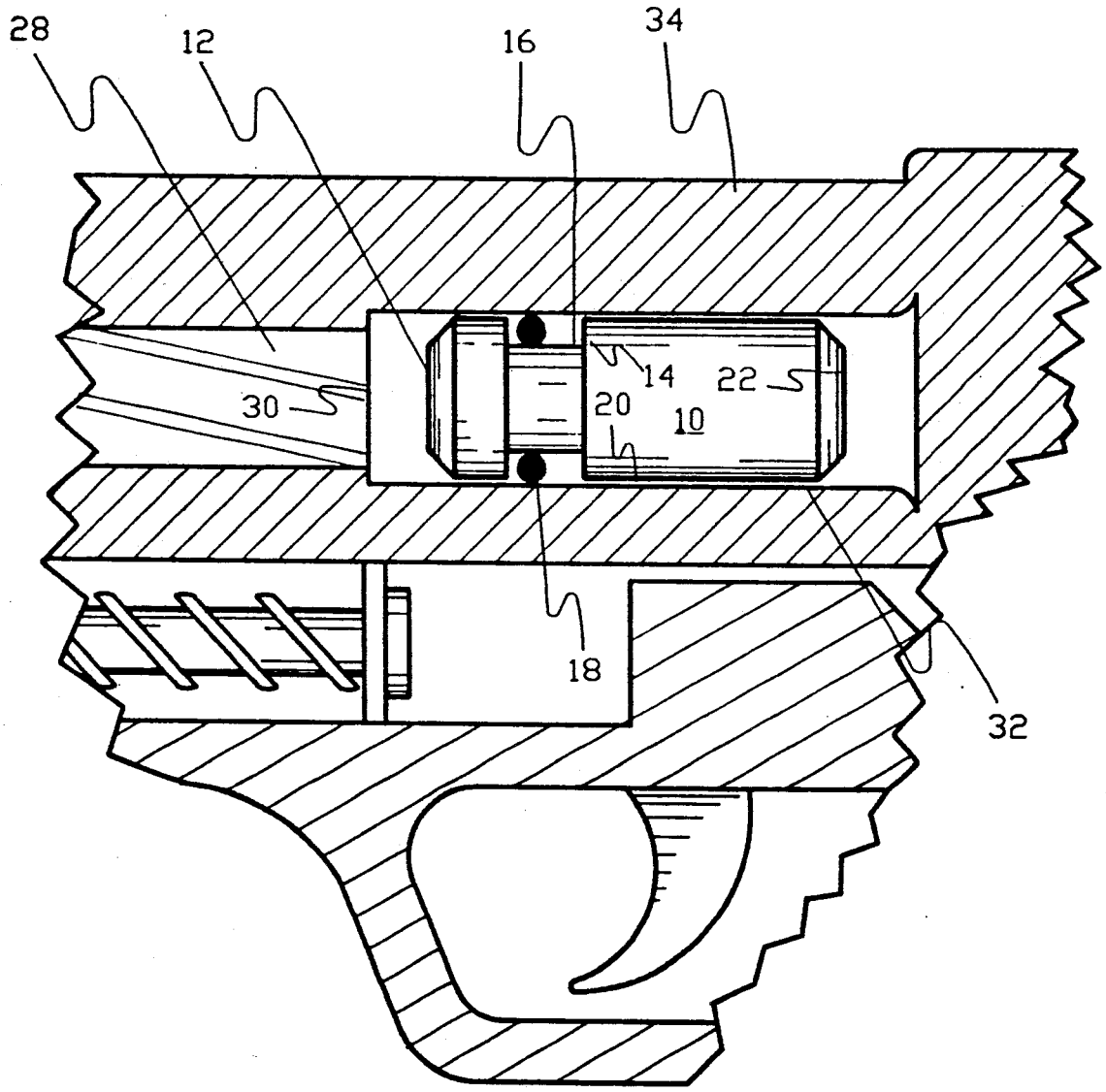
FIG. 3 is a side view of the preferred embodiment of the safety plug in position with the firing chamber in accordance with the invention.

FIG. 3 is a side view of the preferred embodiment of the safety plug 10 in position with the firing chamber 32 of firearm 34. Firearm 34 is typical of a 45 caliber pistol which has little forcing cone area before entering the bore of barrel 30, shown as the area having rifling 28. Attempts to remove safety plug 10 from the breech end of the firearm 34, i.e., end 22 of safety plug 10, will cause end 12 of safety plug 10 to be forced against forcing cone 30 of the barrel, and O-ring 18 to be firmly compressed against the walls of firing chamber 32. Safety plug 10 can only be removed by insertion of a cleaning rod or other suitable rod through the muzzle (not shown) of firearm 32 to push against end 12 of safety plug 10 to cause safety plug 10 to be expelled from firing chamber 32.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A safety plug for insertion into a firing chamber of a firearm, said firearm having a caliber designation, a barrel, muzzle, action and a chamber with a diameter and length, said safety plug comprising:

a cylindrical body portion having a diameter slightly less than the diameter of the firing chamber of said firearm, and having a length slightly less than the length of the firing chamber of said firearm;

an O-ring having a diameter and a thickness corresponding to the caliber of said firearm;

an O-ring groove, disposed circumferentially on said body portion, having a groove depth less than the thickness of said O-ring, having a groove width that is substantially greater than the thickness of said O-ring, such that when said O-ring is inserted within said O-ring groove and said plug is inserted in the firing chamber of said firearm, said plug is firmly held entirely within said firing chamber thereby permitting the action of said firearm to fully close and thereby rendering said firearm safe until said plug is removed by insertion of a rod into the muzzle of said firearm to push said plug free from said firing chamber.

2. The safety plug of claim 2 wherein said body portion is translucent so that the barrel of said firearm can be inspected while said safety plug is in place within said firing chamber.

3. A safety plug for insertion into a firing chamber of a semi-automatic firearm, said firearm having a caliber designation, a barrel, muzzle, ejector, action and a firing chamber with a diameter and length, said safety plug comprising:

a cylindrical body portion having a diameter slightly less than the diameter of the firing chamber of said firearm, and having a length longer than the length of the firing chamber of said firearm;

an O-ring having a diameter and a thickness corresponding to the caliber of said firearm;

an O-ring groove, disposed circumferentially on said body portion, having a groove depth less than the thickness of said O-ring, having a groove width that is substantially greater than the thickness of said O-ring, wherein once said O-ring is inserted within said O-ring groove and said plug is inserted within said firearm, said plug is firmly held within said firing chamber thereby preventing the action of said firearm from fully closing and thereby rendering said firearm visually and mechanically safe until said plug is removed by insertion of a rod into the muzzle of said firearm to push said plug free from said firing chamber.

4. The safety plug of claim 3 wherein said body portion further comprises means for visually identifying at a distance said body portion extending from said firing chamber.

5. The safety plug of claim 4 wherein said means for visually identifying further comprises a part of said body portion being colored-coded to indicate that said safety plug is within said firing chamber and that said firearm is safe.

6. The safety plug of claim 3 wherein said body portion further comprises a chamfered end that extends beyond the length of said firing chamber, said chamfered end having sufficient chamfer to prevent interference with the ejector of said firearm.

* * * * *